US007571970B2

(12) United States Patent
Nystrom et al.

(10) Patent No.: US 7,571,970 B2
(45) Date of Patent: Aug. 11, 2009

(54) SELF-ALIGNED PRECISION DATUMS FOR ARRAY DIE PLACEMENT

(75) Inventors: Peter J. Nystrom, Webster, NY (US); Peter M. Gulvin, Webster, NY (US); John P. Meyers, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 11/777,475

(22) Filed: Jul. 13, 2007

(65) Prior Publication Data

US 2009/0014413 A1 Jan. 15, 2009

(51) Int. Cl.
*B41J 2/155* (2006.01)

(52) U.S. Cl. ..... 347/13; 347/42; 216/27

(58) Field of Classification Search ..... 347/13, 347/42, 49; 216/27
See application file for complete search history.

(56) References Cited

U.S. PATENT DOCUMENTS 4,975,143 A 12/1990 Drake et al.
5,545,913 A 8/1996 Quinn et al.
5,668,400 A 9/1997 Quinn
5,738,799 A 4/1998 Hawkins et al.
6,984,019 B2 * 1/2006 Silverbrook ..... 347/42
6,994,421 B2 * 2/2006 Silverbrook ..... 347/42
7,427,123 B2 * 9/2008 Foote et al. ..... 347/42

* cited by examiner

*Primary Examiner*—Lamson D Nguyen
(74) *Attorney, Agent, or Firm*—MH2 Technology Law Group LLP

(57) ABSTRACT

A method and resulting device for accurately positioning an array of die modules in an imaging array, including larger partial width arrays and full page width arrays, is described herein. The method includes forming physical reference datum directly on an individual silicon die module, and positioning the individual die modules on a temporary holder. The temporary holder includes an alignment tool and singulated die are placed onto the temporary holder by abutting the physical reference datum against the alignment tool. A vacuum temporarily secures the die positioned on the temporary holder, and a permanent substrate is then attached to the die of the temporary holder. The temporary holder is released in favor of the permanent substrate having the accurately aligned die modules thereon.

12 Claims, 5 Drawing Sheets

TYPICAL STAGGERED ARRAY

SELF-ALIGNED PRECISION DATUMS FOR ARRAY DIE PLACEMENT

FIELD OF THE INVENTION

The present invention generally relates to accurately aligning silicon die modules in an imaging array, and more specifically to forming alignment features for precision butting and alignment of multiple silicon die modules when fabricating either a large partial page width or a full page width imaging array.

BACKGROUND OF THE INVENTION

Imaging arrays typically utilize a large number of silicon die modules therein. In order to obtain high quality imaging, it becomes important to precisely align the individual die modules, therefore accurately aligning an array of nozzles for the imaging device.

In order to meet the demands for high accuracy assembly of the die modules onto a substrate, it is known to use high accuracy assembly automation or precision dicing and butting methods. Both of these techniques require complex capital equipment and in some instances are compromised with limited design capability.

It is known that assembly automation can reduce the complexity of the components, but in turn requires accurate alignment markings. Likewise, die butting requires both precision dicing and clean room assembly. These factors all contribute to high upfront expenditures and can therefore directly impact manufacturing costs.

Current solutions to the problem include use of an automated die bonder using machine vision guided placement of the die. Examples of die bonders include equipment by various vendors of flip chip and direct die placement systems. Depending on costs, 3 sigma accuracies of +/−12 μm are achievable and even tighter with more expensive systems.

Thus, there is a need to overcome these and other problems of the prior art and to provide a method for forming physical reference datum directly on an individual silicon die module and using the physical reference datum for precision butting and alignment of multiple silicon die modules when fabricating partial and full width imaging arrays.

SUMMARY OF THE INVENTION

In accordance with the present teachings, a method of accurately positioning an array of die modules in large partial width and full width imaging arrays is provided.

The exemplary method can include forming physical reference datum directly on an individual silicon die module; providing an alignment holder, the alignment holder including an alignment tool; placing the die onto the alignment holder by butting the physical reference datum against the alignment tool; temporarily securing the placed die on the alignment holder; and mating a permanent substrate with the die placed on the alignment holder.

In accordance with the present teachings, an array of accurately aligned die modules in a MEMS jet printhead is provided.

The exemplary array can include a substrate and a plurality of singulated die modules mounted on the substrate. Each singulated die module can include an etched longitudinal reference edge, an etched side notch, and a plurality of etched nozzle holes, each etched feature formed from a common etch process.

In accordance with the present teachings a singulated die module for a full width image array is provided.

The exemplary singulated die module can include an etched longitudinal reference edge, an etched side notch, and a plurality of etched nozzle holes, each etched feature formed from a common photolithographic mask and common etch process.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

DESCRIPTION OF THE EMBODIMENTS

Reference will now be made in detail to the exemplary embodiments of the invention, examples of which are illustrated in the accompanying drawings. However, one of ordinary skill in the art would readily recognize that the same principles are equally applicable to, and can be implemented in devices other than fill width array imaging devices, and that any such variations do not depart from the true spirit and scope of the present invention. Moreover, in the following detailed description, references are made to the accompanying figures, which illustrate specific embodiments. Electrical, mechanical, logical and structural changes may be made to the embodiments without departing from the spirit and scope of the present invention. The following detailed description is, therefore, not to be taken in a limiting sense and the scope of the present invention is defined by the appended claims and their equivalents. Wherever possible, the same reference numbers will be used throughout the drawings to refer to the same or like parts.

Embodiments pertain generally to integrating precision reference edges into individual silicon die modules, and the use thereof for precision butting and alignment of multiple silicon die modules when fabricating full width imaging arrays.

A silicon member having a plurality of ink channels is known as a "die module" or "chip". Each die module can comprise hundreds, thousands, or more of the fluid emitters, spaced 100 or more to the inch. Further, fluid emitters can be spaced 180 or more to the inch. Even further, fluid emitters can be spaced 200 or more to the inch. An exemplary full-width thermal fluid jet fluid ejecting head has one or more die modules forming a full-width array extending across the full width of the receiving medium on which the image is to be printed. In fluid ejecting heads with multiple die modules, each die module can include its own ink supply manifold, or multiple die modules can share a common ink supply manifold.

Figure 1:
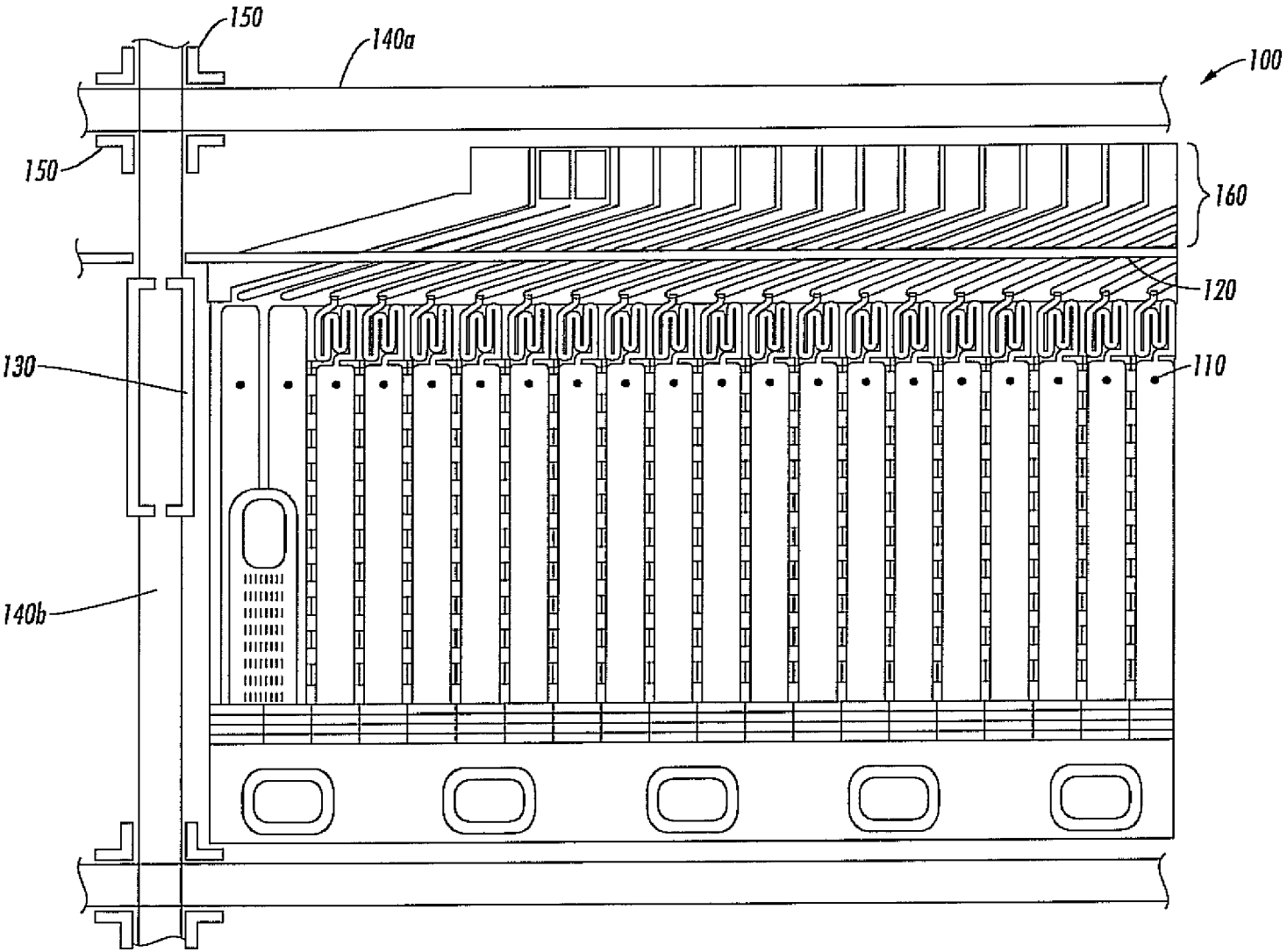
FIG. 1 is a top plan view depicting a portion of a device design in accordance with embodiments of the present teachings.

FIG. 1 is a top plan view depicting a portion of a device design in accordance with embodiments of the present teachings. More specifically, FIG. 1 includes a portion of a nozzle layer 100 in an individual die module (300 of FIG. 3) for a MEMSJet device. Use in a MEMSJet device is exemplary and not intended to limit the subject matter herein. Typically, the nozzle layer 100 can include silicon in order to achieve high quality precision nozzle holes 110. The nozzle holes 110 formed in nozzle layer 100 can be a linear array, shown with sequential numbering across the top of the array. The nozzle layer 100 can further include alignment features 120, 130, and a dicing lane allowance 140 defined by dicing lane markers 150. An electrical interconnect region 160 is also depicted in the nozzle layer 100.

It will be appreciated that the portion of the nozzle layer 100 illustrated in FIG. 1 is only part of an initial larger array of similar non-singulated modules, as known in the art. Detail of the functioning of the nozzle layer, including connections and the like to a printing device, for example, will be omitted as they are not essential to an understanding of the invention and are known in the art.

Dicing lane allowance 140 can be formed to entirely surround a desired die module from an array of die modules. Dicing lane allowance 140 can include a horizontal dicing lane allowance 140*a* and a vertical dicing lane allowance 140*b*. The horizontal dicing lane allowance 140*a* can be parallel to the aligned nozzle holes 110 and the vertical dicing lane allowance 140*b* can be perpendicular to horizontal dicing lane allowance 140*a*. In order to define the dicing lane allowance 140, dicing lane markers 150 are positioned at corners of the nozzle layer 100 for an individual die module. Dicing lane markers 150 can be "L"-shaped brackets whose corners point inward to define an intersection of the horizontal 140*a* and vertical 140*b* dicing lane allowance lines. By way of example, a plurality of die modules (300, FIG. 3) having the characteristics described herein are formed by singulating the die along the dicing lane allowances.

Alignment feature 120 can include a horizontal etch line (long edge alignment feature) positioned substantially parallel to the linear array of nozzle holes 110. Alignment feature 130 can include a notched etch region (side edge alignment feature) at a side of the nozzle etch layer 100 and to an inside of the dicing lane allowance 140. Accordingly, side edge alignment feature 130 can be seen as perpendicular to the horizontal long edge alignment feature.

Each of the nozzle holes 110, the long edge alignment feature 120 and side edge alignment feature 130 are etched using a common photolithographic mask. Accordingly, the long edge alignment feature 120 can be formed perfectly parallel to the nozzle holes 110 and the side edge alignment feature 130 can be accurately aligned to the nozzle holes 110 as well accurately oriented to the long edge alignment feature 120 since each of the nozzle holes 110, long edge alignment feature 120, and side edge alignment feature 130 use the same photolithographic mask. During wafer processing, these features are etched at the same time that the nozzle holes 110 are developed. The etch process is uniform and well controlled, enabling an accurate etching and precise relationship of all etched components.

Figure 2A:
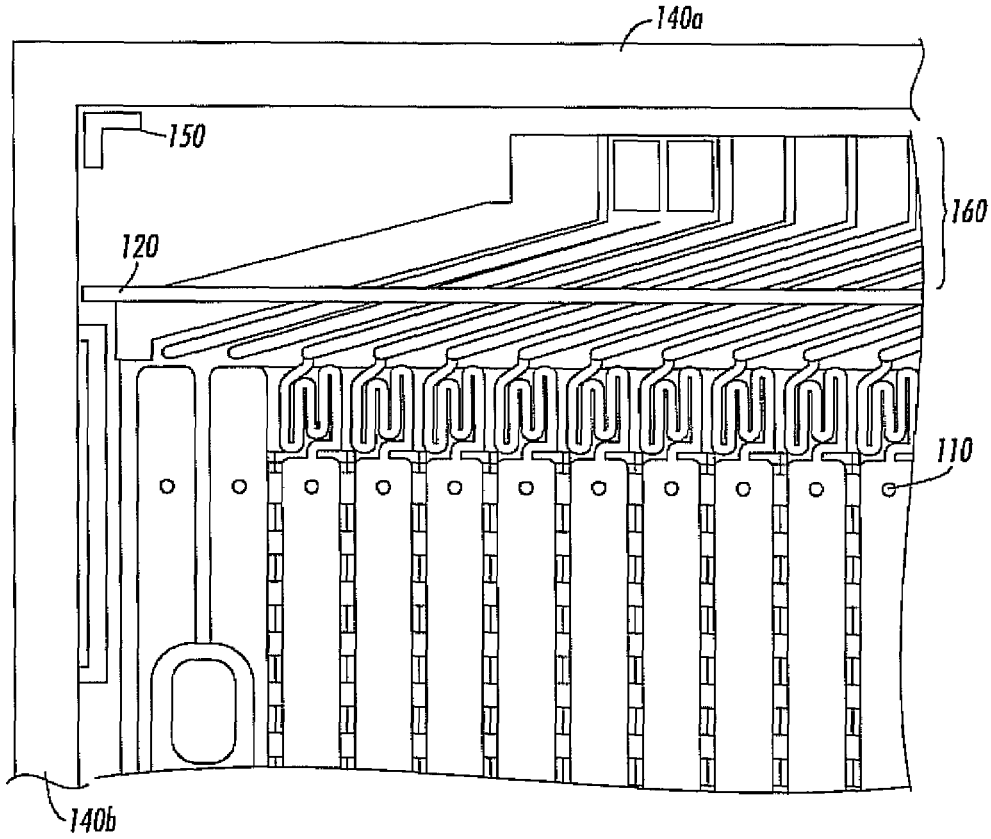
FIG. 2A is a top plan view in detail of the device design of FIG. 1 in accordance with embodiments of the present teachings.
Figure 2B:
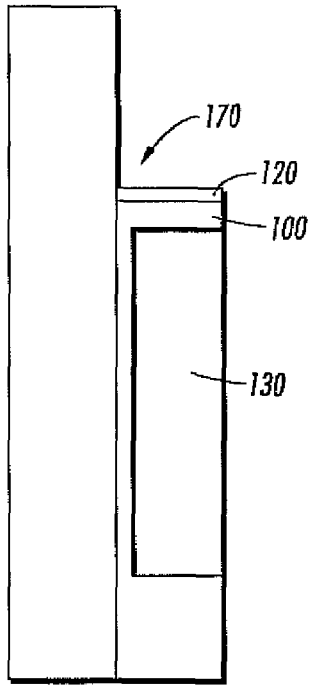
FIG. 2B is a side view taken along lines A-A of FIG. 2A in accordance with embodiments of the present teachings.

FIGS. 2A and 2B illustrate a top plan view and side view, respectively, of FIG. 1 and in more detail. Accordingly, reference numerals corresponding to that of FIG. 1 will be used in FIGS. 2A-B. In FIG. 2A, a notch region characteristic of side edge alignment feature 130 is shown at the edge of the row of nozzle holes 110. It will be appreciated that side edge alignment feature 130 can be of a dimension to stabilize a singulated module 300 against movement when the notch is used as an abutting or alignment feature. Likewise, accuracy of the long edge alignment feature 120 over an entire length thereof and its etching exactly parallel to the nozzle holes 110 provides an accurate stabilization of the module in a horizontal orientation when abutting a horizontal alignment feature.

A step down region 170 in the nozzle layer 100 is depicted in FIG. 2B. The step down region 170 can correspond to the electrical interconnect region 160 and can begin at the long edge alignment feature 120 as shown. The step down from the long edge alignment feature 120 can provide access to the electrical interconnect region 160. In addition, a silicon lid (not shown) can be removed over the electrical interconnect region 160 by the combination of etching along the long edge alignment feature 120 and dicing along the horizontal dicing line 140*a*. Providing access to the electrical interconnect region 160 can be characterized as "windowing". Previously, windowing required an extra etching step. Here, removal of the silicon lid, and providing access to the electrical interconnect region 160 can be accomplished in connection with the etching of the long align feature 140*a* and completed with the horizontal dicing pass. Further, by etching the long edge alignment feature 140*a*, a perfectly straight windowing edge is formed parallel to the nozzle holes 110.

Figure 3:
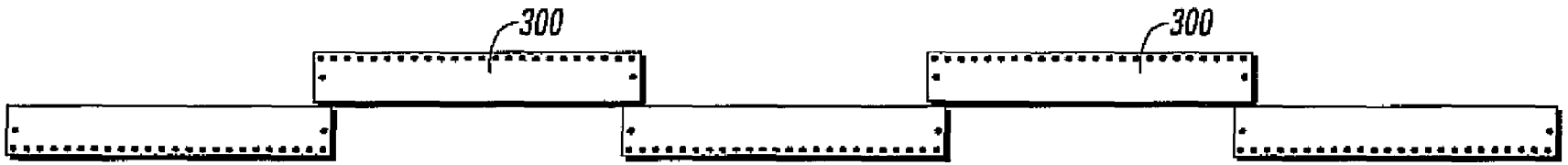
FIG. 3 is a top plan view depicting an example of a staggered array for use with embodiments of the present teachings.

Once the nozzle layer 100 is singulated along dicing lines 140*a*, 14*b*, plural individual die modules 300 result. The individual die modules are typically mounted in a staggered array on a substrate. One example of a staggered array of singulated die modules 300 is depicted in FIG. 3. More specifically, FIG. 3 illustrates an exemplary staggered array pattern for a MEMSJet print head. Singulated die modules 300 can each be about 12 mm ×2 mm in dimension. To create a larger partial page width or full page width arrays, the individual die modules 300 can be aligned in either a linear butted arrangement, or a staggered configuration as shown in FIG. 3. A staggered configuration allows for relaxed dicing and die layout. In addition, the staggered layout allows for potential reworking along with other benefits.

Figure 4A:
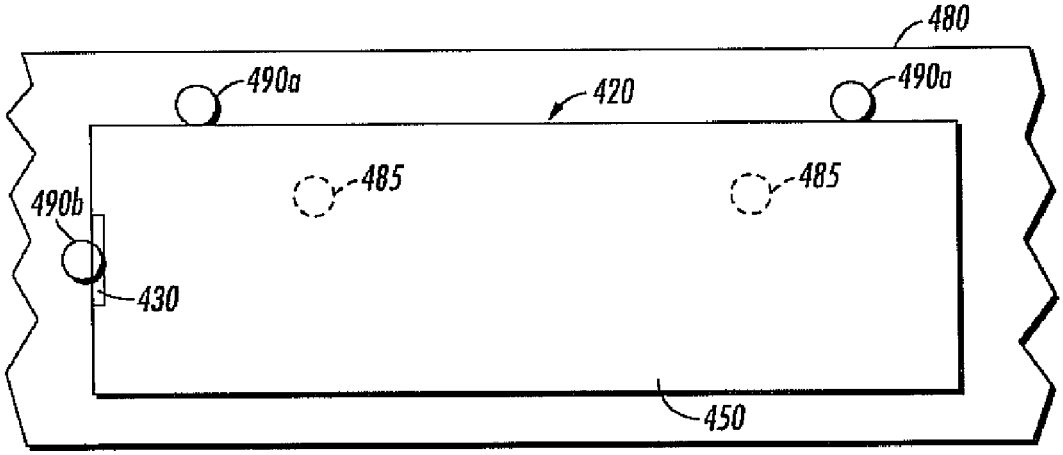
FIG. 4A is a top schematic view illustrating an exemplary die engaged with an alignment tool in accordance with embodiments of the present teachings.
Figure 4B:
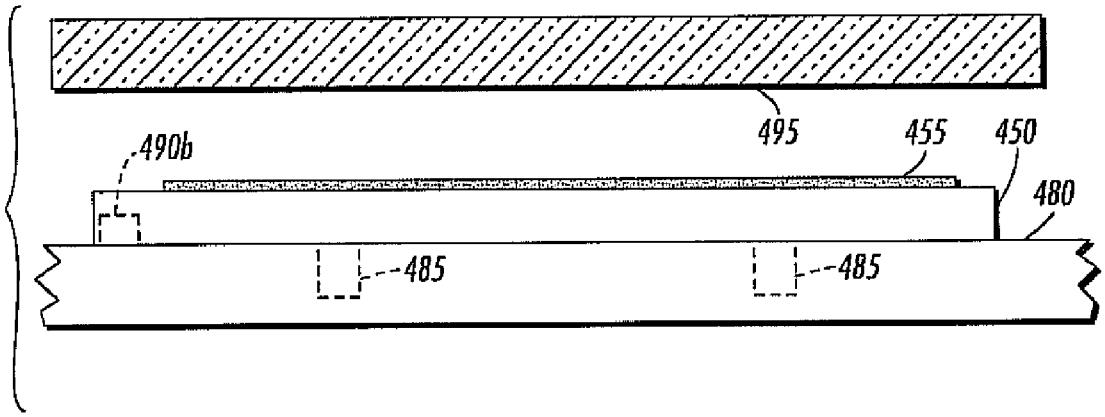
FIG. 4B is a side view of FIG. 4A in accordance with exemplary embodiments of the present teachings.

In order to obtain an accurate layout of die modules, whether in a linear or staggered array, an aspect of the invention is to provide a master alignment tool as shown by way of example in FIG. 4A (top plan view) and FIG. 4B (side view). The alignment tool can include a temporary holder 480 and reference members 490. The reference members 490 can include, for example, pins 490*a* for long edge alignment and pin 490*b* for side edge alignment. The pins 490*a*, 490*b* can act as reference points against which the individual die module 450 can be precisely abutted for alignment in an array. Temporary holder 480 is depicted as supporting a single die module 450, it will be appreciated that temporary holder 480 in fact supports plural such die modules 450 abutted against similar alignment members 490 in order to accurately arrange an array of die modules for a full width imaging array. Although the reference points are described as pins, it will be appreciated that other suitable positioning elements can be used instead, while meeting the parameters herein.

The temporary holder 480 can include a vacuum component 485 positioned to hold aligned die modules 450 in place prior to transfer to a permanent substrate 495. With regard to positioning the individual die modules 450, the long edge alignment feature 420 thereof abuts against corresponding reference pins 490*a*, for example a pair of reference pins. Additionally, the side edge alignment feature 430, specifically the notch, abuts against corresponding side reference pin 490*b*. When both of the long edge reference pins 490*a* and side reference pin 490*b* are abutted by the die module 450, that die module is precisely and accurately aligned with respect to other positioned die modules held on the temporary holder 480 in order to form an accurate array.

As shown by way of example in FIG. 4B, reference pin 490*b* can be of a height less than that of the die 450. With a reference pin height as shown, the reference pin does not interfere with the substrate 495 when the die 450 and substrate 495 are pressed together. Even further, the height of reference pin 49Db can be less than one-half the height of the die 450, to correspond with the 130 region of FIG. 2B. Likewise, reference pins 490*a* can be less than a height of the die 450.

Once the plural individual die modules are precisely positioned, and held in place by vacuum component 485, the array of positioned die modules can be transferred to permanent substrate 495 (FIG. 4B) for use in an imaging array. An adhesive layer 455 can be applied to the permanent substrate 495, and the permanent substrate can be contacted with the exposed surfaces of the die module array on the temporary holder. Upon securing of permanent substrate 495 to the die module array 450, vacuum component 485 can be released and the array of die modules and components transferred to the permanent substrate. It will be appreciated that the adhesive can alternatively be applied to the array of temporarily held die modules rather than to the permanent substrate, and both such procedures are within the scope of the invention.

Although adhesive is identified as an exemplary securing mechanism, other attachment options can be used including tape, solder, or any known method of die attachment.

Upon transfer of the die array to the permanent substrate 495, the subcomponent including the permanent substrate 495 and die module array 450 can be cured in a known manner.

The reference pins of the precision alignment tool can be formed from any number of methods. Exemplary, but non limiting methods can include electroformed nickel, photochemically etched metal, etched silicon, and other similar techniques suitable for forming a master tool having accurately placed protrusions. Acceptable precision can also be obtained with modern computer numerical control (CNC) equipment in drilled and pinned tool steel. CNC can refer to computer controlled machining equipments such as jig borers or vertical mills and other similar machines.

Figure 5:
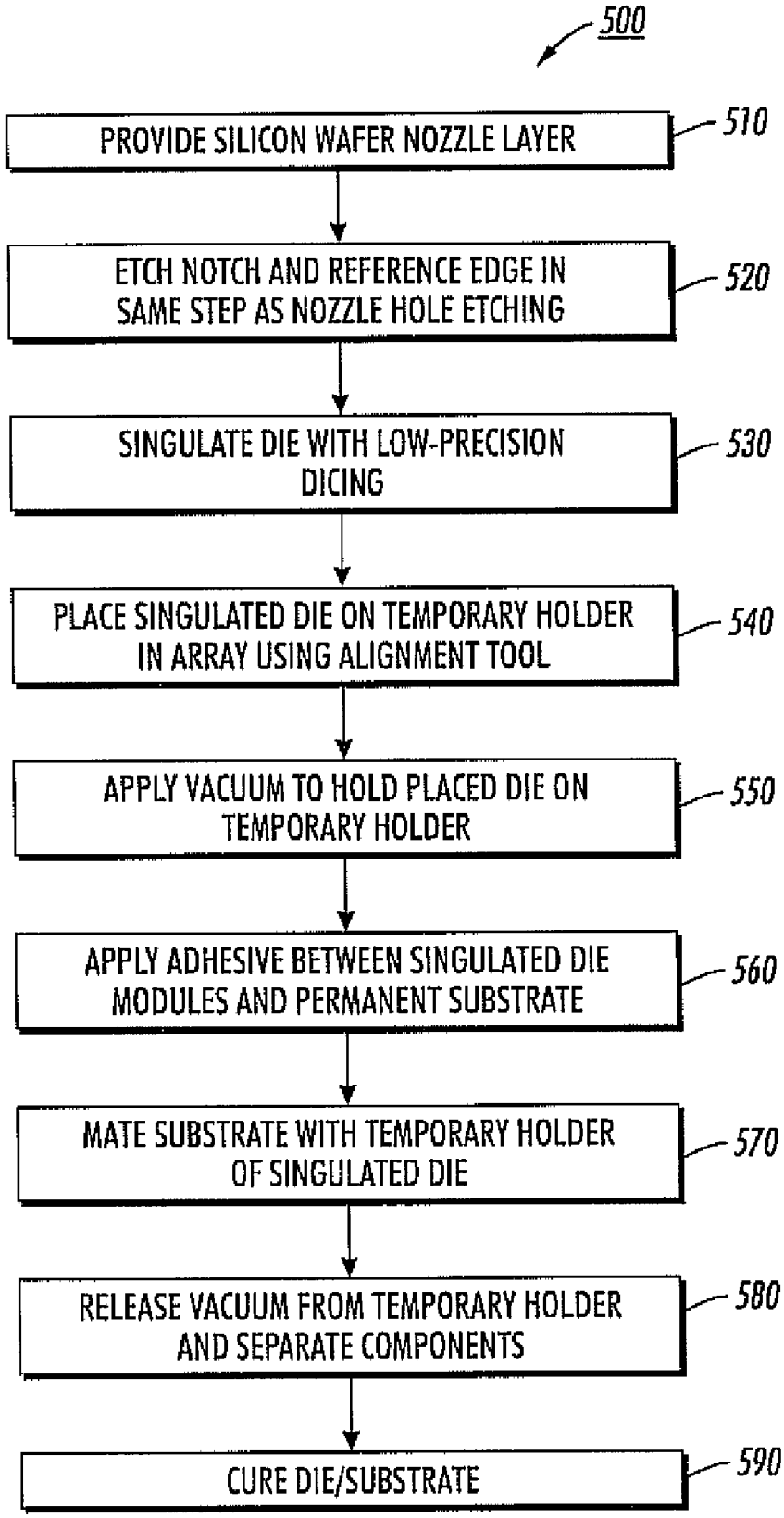
FIG. 5 is a flow chart depicting a method in accordance with exemplary embodiments of the present teachings.

A method of precision butting and alignment is described in connection with FIG. 5. It will be appreciated that while steps are described in an order, certain steps may be added, removed or modified without departing from the scope of the invention.

The method 500 for precision butting and alignment of multiple silicon die modules can include providing a silicon wafer nozzle layer at 510 from which individual die modules are formed. It will be appreciated that included in the silicon nozzle layer are the electrical interconnects and components needed for a nozzle layer of an imaging device. In addition to the known required components, nozzle holes, a side notch and a long edge alignment feature are etched into the nozzle layer at 520. Etching of the side edge alignment feature and the long edge alignment feature are in the same layer as the nozzle holes.

Subsequent to etching of the side and long edge alignment features and nozzle holes, the nozzle layer is singulated at 530. Singulation can be with a low precision dicing due to positioning of the alignment features. At 540, singulated die are placed on a temporary holder in an array or predetermined pattern. Placement is by butting of the side and long edge alignment features against components of the alignment tool provided in connection with the temporary holder. The temporarily positioned singulated die are temporarily held in place by a vacuum at 550. At 560, adhesive can be applied to the permanent substrate and/or die module array, and the permanent substrate is bonded to the temporarily held die modules. At 570, the substrate is attached to or otherwise mated with the temporarily held die on the holder. Upon securement of the die modules to the permanent substrate, the vacuum is released from the temporary holder at 580 in order to release and withdraw the substrate/module subcomponent from the temporary holder. Curing of the die/adhesive occurs at 590 with all die precisely located on the permanent substrate.

Accordingly, by forming precision reference edges in the same layer as the nozzles, an absolute direct reference can be obtained for alignment purposes. Accuracy is further protected by placing the high quality reference edges away from the dicing lines.

Although the relationships of components are described in general terms, it will be appreciated by one of skill in the art can add, remove, or modify certain components without departing from the scope of the exemplary embodiments.

It will be appreciated by those of skill in the art that several benefits are achieved by the exemplary embodiments described herein and include elimination of unnecessary dicing steps to create access to the electrical interconnect region, obtaining a high level of accuracy without tolerance stack up for staggered arrays, and substantially higher accuracy than obtained with precision automation of standard die bonders which rely on visual techniques.

While the invention has been illustrated with respect to one or more exemplary embodiments, alterations and/or modifications can be made to the illustrated examples without departing from the spirit and scope of the appended claims. In particular, although the method has been described by examples, the steps of the method may be performed in a difference order than illustrated or simultaneously. In addition, while a particular feature of the invention may have been disclosed with respect to only one of several embodiments, such feature may be combined with one or more other features of the other embodiments as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." And as used herein, the term "one or more of" with respect to a listing of items such as, for example, "one or more of A and B," means A alone, B alone, or A and B.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any an all sub-ranges between (and including) the minimum value of zero and the maximum value of 10, that is, any and all sub-ranges having a minimum value of equal to or greater than zero and a maximum value of equal to or less than 10, e.g., 1 to 5.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims and their equivalents.

What is claimed is:

1. A method for accurately positioning an array of die modules in an imaging array, the method comprising:

forming physical reference datum directly on an individual silicon die module;

providing a temporary holder, the temporary holder including an alignment tool;

placing the die onto the temporary holder by butting the physical reference datum against the alignment tool; and temporarily securing the placed die on the temporary holder; and attaching a permanent substrate to the die placed on the temporary holder.

2. The method of claim 1, wherein attaching comprises applying an adhesive between the permanent substrate and die modules, and further comprising withdrawing the permanent substrate from the temporary holder and curing the permanent substrate and array of die modules.

3. The method of claim 1, wherein forming the physical reference datum comprises forming a photolithographic pattern on a silicon wafer in a nozzle layer, and etching the pattern on the wafer to define the reference datum.

4. The method of claim 3, further comprising dicing the silicon wafer along a predefined pattern to form a plurality of individual silicon die modules, each including the physical reference datum.

5. The method of claim 1, wherein the physical reference datum comprise a longitudinal edge align feature and a side edge align feature.

6. The method of claim 5, wherein the edge align feature comprises a notch aligned with a plurality of concurrently etched nozzle openings.

7. The method of claim 5, wherein the longitudinal align feature comprises a longitudinal etched slot parallel to the plurality of concurrently etched nozzle openings.

8. The method of claim 1, further comprising providing intersecting horizontal and vertical dicing lines along which individual die are separated.

9. The method of claim 8, further comprising removing a silicon lid by dicing along the horizontal dicing line and separating at the longitudinally etched slot.

10. The method of claim 1, wherein the alignment tool comprises pins positioned to engage with the longitudinal edge align feature and the side edge align feature of the die module.

11. The method of claim 1, further comprising applying a vacuum force for holding aligned die modules on the temporary holder.

12. The method of claim 8, wherein alignment features are formed inside of dicing lines on a silicon wafer.

* * * * *